US009512510B2

(12) United States Patent
Hatta

(10) Patent No.: US 9,512,510 B2
(45) **Date of Patent: *Dec. 6, 2016**

(54) HIGH-STRENGTH ALUMINUM ALLOY AND PROCESS FOR PRODUCING SAME

(71) Applicant: UACJ Corporation, Tokyo (JP)
(72) Inventor: Hidenori Hatta, Aichi (JP)
(73) Assignee: UACJ CORPORATION, Tokyo (JP)

( * ) Notice: Subject to any disclaimer, the term of this patent is extended or adjusted under 35 U.S.C. 154(b) by 304 days.

This patent is subject to a terminal disclaimer.

(21) Appl. No.: 14/349,239
(22) PCT Filed: Nov. 5, 2012

(86) PCT No.: PCT/JP2012/078619
§ 371 (c)(1),
(2) Date: Apr. 2, 2014

(87) PCT Pub. No.: WO2013/069603
PCT Pub. Date: May 16, 2013

(65) Prior Publication Data

US 2014/0246127 A1 Sep. 4, 2014

(30) Foreign Application Priority Data

Nov. 7, 2011 (JP) ..... 2011-243923
Jul. 27, 2012 (JP) ..... 2012-167249

(51) Int. Cl.
*C22F 1/053* (2006.01)
*C22C 21/10* (2006.01)
(Continued)

(52) U.S. Cl.
CPC ..... *C22F 1/053* (2013.01); *C22C 21/00* (2013.01); *C22C 21/10* (2013.01); *C22F 1/00* (2013.01)

(58) Field of Classification Search
CPC ..... C22C 21/10; C22F 1/053
USPC ..... 148/415, 417, 439, 440, 690, 694; 420/532, 541
See application file for complete search history.

(56) References Cited

U.S. PATENT DOCUMENTS 7,018,489 B2 3/2006 Bennon et al.
8,105,449 B2 1/2012 Yoshida et al.
(Continued)

FOREIGN PATENT DOCUMENTS

CN 1692174 A 11/2005
CN 1940106 A 4/2007
(Continued)

OTHER PUBLICATIONS

Office Action from the Chinese Patent Office dated Feb. 27, 2015 in related Chinese application No. 2011800718596, and translation of substantive portions thereof.
(Continued)

*Primary Examiner* — Brian Walck
(74) *Attorney, Agent, or Firm* — J-TEK LAW PLLC; Jeffrey D. Tekanic; Scott T. Wakeman

(57) ABSTRACT

A high-strength aluminum alloy material having a chemical composition which includes Zn: more than 7.2% (mass %, the same applies hereafter) and 8.7% or less, Mg: 1.3% or more and 2.1% or less, Cu: 0.01% or more and 0.10% or less, Zr: 0.01% or more and 0.10% or less, Cr: less than 0.02%, Fe: 0.30% or less, Si: 0.30% or less, Mn: less than 0.05%, Ti: 0.001% or more and 0.05% or less, the balance being Al and unavoidable impurities, is provided. It has a proof stress of 350 MPa or more, and a metallographic structure formed of a recrystallized structure, and L* and b* values, as defined in JIS Z8729 (ISO 7724-1), are 85 or more and 95 or less and 0 or more and 0.8 or less, respectively, as measured after anodization using a sulfuric acid bath.

20 Claims, 2 Drawing Sheets

(51) Int. Cl.

| | |
|---|---|
| ***C22C 21/00*** | (2006.01) |
| ***C22F 1/00*** | (2006.01) |

(56) References Cited

U.S. PATENT DOCUMENTS

| | | | |
|---|---|---|---|
| 2004/0056075 | A1 | 3/2004 | Gheorghe |
| 2004/0099352 | A1 | 5/2004 | Gheorghe et al. |
| 2005/0236075 | A1 | 10/2005 | Gheorghe et al. |
| 2006/0016523 | A1 | 1/2006 | Dif et al. |
| 2006/0157172 | A1 | 7/2006 | Fischer et al. |
| 2007/0029016 | A1 | 2/2007 | Gheorghe |
| 2007/0074791 | A1 | 4/2007 | Yoshida et al. |
| 2007/0151636 | A1 | 7/2007 | Buerger et al. |
| 2007/0187007 | A1 | 8/2007 | Gheorghe et al. |
| 2008/0299000 | A1 | 12/2008 | Gheorghe et al. |
| 2014/0096878 | A1 | 4/2014 | Hatta et al. |
| 2014/0124103 | A1 | 5/2014 | Hatta |

FOREIGN PATENT DOCUMENTS

| | | | |
|---|---|---|---|
| CN | 101243196 | A | 8/2008 |
| EP | 0462055 | A1 | 12/1991 |
| JP | S60194041 | A | 10/1985 |
| JP | H06-128678 | A | 5/1994 |
| JP | H06-330264 | A | 11/1994 |
| JP | 2000-119782 | A | 4/2000 |
| JP | 2001-355032 | A | 12/2001 |
| JP | 2007-119904 | A | 5/2007 |
| JP | 2010159489 | A | 7/2010 |
| JP | 5023232 | B1 | 9/2012 |
| WO | 2004046402 | A2 | 6/2004 |
| WO | 2007009616 | A1 | 1/2007 |
| WO | 2008003506 | A2 | 1/2008 |
| WO | 2009024601 | A1 | 2/2009 |

OTHER PUBLICATIONS

Office Action from the Chinese Patent Office dated Apr. 22, 2015 in related Chinese application No. 201280036669.5, and translation thereof.

Office Action from the Korean Patent Office mailed Sep. 5, 2015 in related Korean patent application No. 10-2014-7001906, including translation thereof.

Office Action from the Korean Patent Office mailed Sep. 5, 2015 in related Korean patent application No. 10-2014-7001916, including translation thereof.

Non-final Office Action mailed Nov. 30, 2015 in U.S. Appl. No. 14/128,435.

Amendment and Response filed on Feb. 29, 2016 in U.S. Appl. No. 14/128,435.

Second Office Action from the Chinese Patent Office dated Jan. 7, 2016 in related Chinese application No. 201280036669.5, and machine translation thereof.

English translation of International Preliminary Report on Patentability for parent application No. PCT/JP2012/078619, Mailed Jan. 29, 2013.

English translation of International Search Report for parent application No. PCT/JP2012/078619, Mailed Jan. 29, 2013.

Un-published U.S. Appl. No. 14/040,630, filed Sep. 28, 2013.

Un-published U.S. Appl. No. 14/128,435, filed Dec. 15, 2013.

HIGH-STRENGTH ALUMINUM ALLOY AND PROCESS FOR PRODUCING SAME

CROSS-REFERENCE

This application is the US national stage of International Patent Application No. PCT/JP2012/078619 filed on Nov. 5, 2012, which claims priority to Japanese Patent Application No. 2011-243923, filed on Nov. 7, 2011 and to Japanese Patent Application No. 2012-167249, filed on Jul. 27, 2012.

TECHNICAL FIELD

The present invention relates to a high-strength aluminum alloy material that can be used at portions where both strength characteristics and appearance characteristics are considered to be important.

BACKGROUND ART

High-strength and lightweight aluminum alloys are being increasingly employed as materials for use in applications wherein both strength characteristics and appearance characteristics are considered to be important, such as transport machines, sporting goods and machine components. For these applications, because durability is required, there is a desire for aluminum alloys having a proof stress of 350 MPa or more.

7000-series aluminum alloys obtained by adding Zn and Mg to aluminum are known as aluminum alloys which exhibit such high strength. 7000-series aluminum alloys exhibit high strength due to age-precipitation of Al—Mg—Zn-based precipitates. Also, among 7000-series aluminum alloys, those to which Cu has been added in addition to Zn and Mg exhibit the highest strength among the aluminum alloys.

7000-series aluminum alloys are produced, for example, by hot extrusion, and are used in transport equipment such as aircraft and vehicles, sporting goods and machine components which are required to have high strength. In case they will be used in such applications, the required characteristics include, in addition to strength, stress corrosion cracking, impact absorption and ductility. For example, the aluminum alloy extruded material described in Patent Document 1 has been proposed as an example of an aluminum alloy that satisfies the above-mentioned characteristics.

PRIOR ART DOCUMENT

Patent Documents

Patent Document 1: JP 2007-119904 A

SUMMARY OF THE INVENTION

However, in 7000-series aluminum alloys having a high proof stress produced within a conventional elemental range by a conventional manufacturing process, for example, when anodization, etc. is performed to prevent surface scratching, there is a problem of the appearance in that streak patterns may appear on the surface.

Also, after performing the surface treatment such as anodization, the above-described aluminum alloys are desired to have a silver color in order to engender a luxurious impression. However, when anodizing is performed on the above-described conventional 7000-series aluminum alloys, there has been a problem of appearance in that the surface would be strongly tinged with a yellowish color tone.

Thus, the above-described conventional 7000-series aluminum alloys have been difficult to use since the streak patterns and the changes in color tone appearing after the surface treatment have caused surface quality problems.

The present invention has been made in view of such circumstances, and an object of the invention is to provide a high-strength aluminum alloy material having an excellent surface quality after anodization and a process for producing the same.

One aspect of the present invention is a high-strength aluminum alloy material having:

a chemical composition which comprises Zn: more than 7.2% (mass %, the same applies hereafter) and 8.7% or less, Mg: 1.3% or more and 2.1% or less, Cu: 0.01% or more and 0.10% or less, Zr: 0.01% or more and 0.10% or less, Cr: less than 0.02%, Fe: 0.30% or less, Si: 0.30% or less, Mn: less than 0.05%, Ti: 0.001% or more and 0.05% or less, and the balance being Al and unavoidable impurities;

it has a proof stress of 350 MPa or more, a metallographic structure comprised of a recrystallized structure, and L* and b* values, as defined in JIS Z8729 (ISO 7724-1), of 85 or more and 95 or less and 0 or more and 0.8 or less, respectively, as measured after anodization using a sulfuric acid bath.

Another aspect of the present invention is a manufacturing method of a high-strength aluminum alloy material, which includes:

preparing an ingot having a chemical composition which contains Zn: more than 7.2% (mass %, the same applies hereafter) and 8.7% or less, Mg: 1.3% or more and 2.1% or less, Cu: 0.01% or more and 0.10% or less, Zr: 0.01% or more and 0.10% or less, Cr: less than 0.02%, Fe: 0.30% or less, Si: 0.30% or less, Mn: less than 0.05%, Ti: 0.001% or more and 0.05% or less, and the balance being Al and unavoidable impurities;

performing a homogenization treatment that heats the ingot at a temperature of higher than 540° C. and 580° C. or lower for 1 hour to 24 hours;

subsequently, forming a wrought material by performing hot working on the ingot in a state where the temperature of the ingot at the beginning of the working is 440° C. to 560° C.;

starting to cool the wrought material while at 400° C. or higher, and performing a quenching treatment that cools by controlling the average cooling rate to 5° C./sec. or more and 1000° C./sec. or less while the temperature of the wrought material is in the range of from 400° C. to 150° C.;

cooling the temperature of the wrought material to room temperature by said quenching treatment or by a subsequent cooling; and thereafter, performing an artificial aging treatment that heats the wrought material.

The above-described high-strength aluminum alloy material has the above-described specific chemical composition. Therefore, the material has a proof stress equivalent to that of the conventional 7000-series aluminum alloy materials, can also suppress, for example, changes in color tone that occur after a surface treatment and can provide a good surface quality.

Also, the high-strength aluminum alloy material has a proof stress of 350 MPa or more. Therefore, the material can relatively easily satisfy the requirements for strength as a material for use in applications wherein both of strength characteristics and appearance are considered to be important.

Further, the metallographic structure of the high-strength aluminum alloy material is comprised of a recrystallized structure. Therefore, it is possible to suppress, for example, the generation of streak patterns due to fibrous structures after the surface treatment and to obtain a good surface quality.

Furthermore, after anodization using a sulfuric acid bath, the high-strength aluminum alloy material has L* and b* values that fall within the above-described specific ranges. Since an aluminum alloy having L* and b* values falling within the above-described ranges exhibits a silver color when visually observed, the above-described high-strength aluminum alloy material is a material that excels in design properties after anodization.

As described above, the above-described high-strength aluminum alloy material is a high-strength aluminum alloy material that excels in surface quality after anodization.

Next, in the above-described process for producing a high-strength aluminum alloy material, the high-strength aluminum alloy material is produced using the above-described specific treatment temperature, treatment time and treatment procedures. In this way, the high-strength aluminum alloy material can be easily obtained.

MODES FOR CARRYING OUT THE INVENTION

Figure 1:
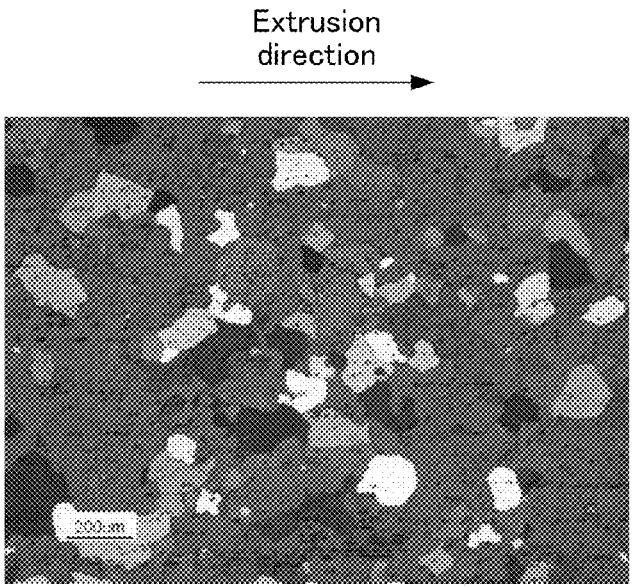
FIG. 1 shows a photograph of the recrystallized structure of Sample No. 1 in Example 1.

The high-strength aluminum alloy material contains both more than 7.2% and 8.7% or less of Zn and 1.3% or more and 2.1% or less of Mg. Due to coexisting in the aluminum alloy, Zn and Mg precipitate the η' phase. Therefore, the above-mentioned high-strength aluminum alloy material that contains both has increased strength due to enhanced precipitation.

If the Zn content is 7.2% or less, the strength improving effect will be low since the precipitated amount of the η' phase is small. Therefore, the Zn content is preferably more than 7.2%, more preferably 7.5% or more. On the other hand, if the Zn content exceeds 8.7%, productivity is reduced since the hot workability deteriorates. Therefore, the Zn content is preferably 8.7% or less, more preferably 8.5% or less.

If the Mg content is less than 1.3%, the strength improving effect will be low since the precipitated amount of the η' phase is small. On the other hand, if the Mg content exceeds 2.1%, productivity is reduced since the hot workability deteriorates.

Furthermore, the high-strength aluminum alloy material contains 0.01% or more and 0.10% or less of Cu. Cu may be mixed when a recycled material is used as a raw material for the high-strength aluminum alloy material. If the Cu content exceeds 0.10%, the surface quality deteriorates due to the reduction in luster after chemical polishing, changes in color tone to yellow by anodization, and the like.

On the other hand, if the Cu content is less than 0.01%, a precipitate-free zone having a width of a few tenths of a micrometer is likely to be formed near the crystal grain boundary of the recrystallized structure. After formation of this precipitate-free zone, a scale-like pattern is likely to appear on the surface after anodization, and consequently the surface quality may deteriorate. Such deterioration in surface quality can be avoided by controlling the Cu content in the range of 0.01% or more and 0.10% or less.

Also, the high-strength aluminum alloy material contains 0.01% or more and 0.10% or less of Zr. Zr forms an AlZr-based intermetallic compound, thereby providing the effect of making the crystal grain diameter of the recrystallized structure fine. If the Zr content is less than 0.01%, a precipitate-free zone having a width of a few tenths of a micrometer is likely to be formed near the crystal grain boundary of the recrystallized structure. After formation of this precipitate-free zone, a scale-like pattern is likely to appear on the surface after anodization, and consequently the surface quality may deteriorate.

On the other hand, if the Zr content exceeds 0.10%, the generation of a recrystallized structure is suppressed, and, instead a fibrous structure is easily generated. In the presence of the fibrous structure, a streak pattern due to the fibrous structure readily appears on the surface after anodization, so that the surface quality is likely to deteriorate. Such deterioration in surface quality can be suppressed by controlling the Zr content in the range of 0.01% or more and 0.10% or less.

Among the above-described chemical components, the content of Cr is restricted to less than 0.02%. If Cr is contained in an amount of 0.02% or more, the surface after anodization is likely to develop a yellowish tone. The deterioration in surface quality due to such a color tone change or the like can be suppressed by regulating the Cr content in the range of less than 0.02%.

Furthermore, in the above-described chemical components, the respective contents are each restricted as follows: Fe to 0.30% or less, Si to 0.30% or less and Mn to less than 0.05%. Fe and Si are components which are likely to be mixed as impurities in an aluminum base metal, and Mn is a component which is likely to be mixed when a recycled material is used.

The Fe, Si and Mn have the effect of suppressing recrystallization by respectively forming AlMn-based, AlMnFe-based and AlMnFeSi-based intermetallic compounds in combination with Al. Therefore, the generation of the recrystallized structure is suppressed when the above-mentioned three components are excessively mixed in the high-strength aluminum alloy material and, instead, a fibrous structure is readily generated. When (a) the fibrous structure (s) are present, streak patterns due to the fibrous structure (s) are likely to occur on the surface after anodization and the surface quality is likely to deteriorate.

The deterioration in surface quality caused by such streak patterns can be suppressed by respectively restricting as follows: Fe to 0.30% or less, Si to 0.30% or less and Mn to less than 0.05%.

Furthermore, the high-strength aluminum alloy material contains 0.001% or more and 0.05% or less of Ti. When added to an aluminum alloy material, Ti has an effect of making the ingot structure fine. Since the ingot structure becomes finer, a higher luster without spots can be obtained, and the surface quality can be improved by incorporating Ti.

If the Ti content is less than 0.001%, the ingot structure is not made sufficiently fine. Therefore, spots may appear on the luster of the high-strength aluminum alloy material.

Furthermore, if the Ti content is more than 0.05%, dot-like defects are easily generated, for example, due to an AlTi-based intermetallic compound formed in combination with Al, so that the surface quality is likely to deteriorate.

Further, the high-strength aluminum alloy material has a proof stress, as defined in JIS Z2241 (ISO 6892-1), of 350 MPa or more. Consequently, it is possible to relatively easily obtain strength characteristics which enable thinning for weight reduction.

Further, the high-strength aluminum alloy material has a metallographic structure comprised of the granular recrystallized structure. Since an aluminum alloy material produced by performing hot working normally has a metallographic structure composed of (a) fibrous structure(s), (a) streak pattern(s) is(are) likely to appear on the luster of its surface or the like, resulting in a deteriorated surface quality. On the other hand, in the above-mentioned high-strength aluminum alloy material, the metallographic structure is composed of the recrystallized structure, and thus no streak patters appears on the surface, thereby providing a good surface quality.

Furthermore, the high-strength aluminum alloy material has L* and b* values, as defined in JIS Z8729 (ISO7724-1), of 85 or more and 95 or less and 0 or more and 0.8 or less, respectively, as measured after anodization using a sulfuric acid bath. The aluminum alloy material, having L* and b* values after anodization which fall within the above-described ranges, exhibits a silver color when visually observed, and thus serves as the aluminum alloy material that excels in design properties. Here, the high-strength aluminum alloy material can realize a color tone which provides an L* value of 85 or more and a b* value of 0.8 or less, due to the specific chemical components thereof.

If the L* value is less than 85, the high-strength aluminum alloy material exhibits a gray color, so that the design properties are likely to deteriorate. Also, if the L* value exceeds 95, the luster on the surface after anodization excessively increases, so that the design properties are likely to deteriorate. On the other hand, the b* value exceeds 0.8, the color tone becomes yellowish after anodization, so that the design properties are likely to deteriorate. It is noted that, in case anodization is performed on an aluminum alloy material having the above-described chemical components, it is difficult to obtain an aluminum alloy material having a b* value of less than 0.

Also, the recrystallized structure may include crystal grains that have an average particle diameter of 500 μm or less; a crystal grain length in a direction parallel to the hot working direction is 0.5 to 4 times as long as the crystal grain length in a direction perpendicular to the hot working direction.

If the average particle diameter of the crystal grains exceeds 500 μm, the crystal grains become excessively coarse. Therefore, after a surface treatment such as anodization, spots are easily generated on the surface, so that the surface quality is likely to deteriorate. Therefore, a smaller average particle diameter of the crystal grains is better. However, if the average particle diameter is less than 50 μm, (a) fibrous structure(s) is (are) likely to remain between the above-mentioned crystal grains. Thus, the average particle diameter of the crystal grains is preferably 500 μm or less, more preferably 50 μm or more and 500 μm or less in order to obtain a good surface quality.

Furthermore, if the aspect ratio of the above crystal grains (which refers to the ratio of the crystal grain length in a direction parallel to the hot working direction to the crystal grain length in a direction perpendicular to the hot working direction) exceeds 4, (a) streak pattern(s) is (are) likely to appear on the surface after a surface treatment such as anodization. On the other hand, it is difficult to obtain crystal grains having an aspect ratio of less than 0.5 by using most manufacturing equipment.

It is noted that it can be confirmed whether the metallographic structure is a recrystallized structure, for example, by applying electrolytic polishing to the surface of an aluminum alloy material and observing the resulting surface using a polarizing microscope. Specifically, if the metallographic structure is formed of a recrystallized structure, a uniform metallographic structure composed of granular crystals is observed, and no solid phases which may be formed during casting, as typified by coarse intermetallic compounds, floating crystals and the like, are observed. In addition, no streak structures (so-called worked structures) formed by plastic working such as extrusion or rolling are observed in the metallic structure formed of a recrystallized structure.

Also, the average particle diameter of the crystal grains in the recrystallized structure can be calculated according to the cutting method defined in JIS G 0551 (ASTM E 112-96, ASTM E 1382-97), which is applied to a metallographic structure image obtained by observation using the polarizing microscope. Specifically, one sectioning line is drawn in each of the vertical, transverse and diagonal directions at any position in the metallographic structure image, and the length of these sectioning lines is divided by the number of crystal grain boundaries intercepting the sectioning lines so as to calculate the average particle diameter.

The aspect ratio (which refers to the ratio of the crystal grain length in a direction parallel to a hot working direction to the crystal grain length in a direction perpendicular to the hot working direction) can be calculated according to the method described above. Specifically, as is the case with the method described above, sectioning lines are drawn in the directions parallel and perpendicular to the hot working direction, respectively, at any position in the metallographic structure image to calculate the average particle diameters in the directions parallel and perpendicular to the hot working direction from the respective sectioning lines. Then, the aspect ratio can be calculated by dividing the average particle diameter in the direction parallel to the hot working direction by the average particle diameter in the direction perpendicular to the hot working direction.

Also, the recrystallized structure is preferably a recrystallized structure generated during hot working. Recrystallized structures can be classified into dynamic recrystallized structures and static recrystallized structures depending on their production process; recrystallized structures generated by deformation and, at the same time, repeated recrystallization during hot working are referred to as the dynamic recrystallized structures. On the other hand, static recrystallized structures refer to those generated by performing additional heat treatment steps such as a solution heat treatment or an annealing treatment after the hot working or cold working. While the above-described problem can be solved by either recrystallized structure, in the case of the dynamic recrystallized structure, it can be easily produced since the production becomes simpler.

As described above, the high-strength aluminum alloy material is a material that excels in surface quality, as well as having high strength. Also, in case anodization is carried out, it is possible to obtain a surface that excels in design properties, which is free of defects and exhibits a silver color when visually observed. Therefore, the high-strength aluminum alloy material can be suitably used as a part where both of strength characteristics and appearance characteristics are considered to be important.

Next, the process for producing a high-strength aluminum alloy material involves a homogenization treatment wherein an ingot having the above-described chemical composition is heated at a temperature of higher than 540° C. and 580° C. or lower for a period of 1 hour or more and 24 hours or less.

If the heating temperature of the homogenization treatment is 540° C. or lower, the homogenization of the ingot segregation layer will be insufficient, resulting in a coarsening of crystal grains, the formation of (a) non-uniform crystalline structure(s) and the like, so that the surface quality of the finally-obtained alloy material deteriorates. On the other hand, if the heating temperature is higher than 580° C., the ingot is likely to locally melt, whereby the manufacturing becomes difficult. Thus, the temperature of the homogenization treatment is preferably higher than 540° C. and 580° C. or lower.

Furthermore, if the heating time for the homogenization treatment is less than 1 hour, the homogenization of the ingot segregation layer will be insufficient, so that the final surface quality deteriorates, as with the above case. On the other hand, when the heating time exceeds 24 hours, the ingot segregation layer has already reached a sufficiently homogenized state, so that no further effect can be expected. Therefore, the time for the homogenization treatment is preferably 1 hour or more and 24 hours or less.

Next, the ingot subjected to the homogenization treatment is made into a wrought material by subjecting to hot working. The temperature of the ingot at the beginning of the hot working is set to 440° C. or higher and 560° C. or lower.

If the ingot heating time before hot working is lower than 440° C., the resistance to deformation is so high that working in a manufacturing facility actually used will be difficult. On the other hand, if the ingot is subjected to hot working after heating up to a temperature higher than 560° C., the ingot locally melts due to heat generation during the hot working, and, as a result, hot cracking is likely to occur. Therefore, the temperature of the ingot before hot working is preferably 440° C. or higher and 560° C. or lower.

Further, extrusion working, rolling working and the like can be employed as the hot working.

After the hot treatment, cooling is started while the temperature of the wrought material remains 400° C. or higher, and a quenching treatment is performed that cools the wrought material to a temperature of 150° C. or lower.

If the temperature of the wrought material before the quenching treatment is lower than 400° C., the quench hardening will be insufficient, and consequently the proof stress of the resulting wrought material may be less than 350 MPa. Furthermore, if the temperature of the wrought material after the quenching treatment exceeds 150° C., the quench hardening will be insufficient, and consequently the proof stress of the resulting wrought material may be less than 350 MPa.

Further, with respect to the quenching treatment, it means a treatment that involves cooling the wrought material by use of a forcible means.

For example, shower cooling or water cooling can be employed as the quenching treatment.

Furthermore, the quenching treatment is performed while controlling the average cooling rate in the range of 5° C./sec. or more and 1000° C./sec. or less while the temperature of the wrought material is in the range of from 400° C. to 150° C.

If the average cooling rate exceeds 1000° C./sec., the equipment becomes excessive, but nevertheless no commensurate effect can be obtained. On the other hand, if the cooling rate is less than 5° C./sec., the quench hardening will be insufficient, and consequently the proof stress of the resulting wrought material may not reach 350 MPa. Therefore, a faster cooling rate is better, and the cooling rate is preferably 5° C./sec. or more and 1000° C./sec. or less, more preferably 100° C./sec. or more and 1000° C./sec. or less.

Furthermore, the temperature of the wrought material is brought to room temperature after the quenching treatment. The temperature of the wrought material may be brought to room temperature either by the rapid cooling treatment itself or by an additional cooling treatment after the quenching treatment. Since the effect of room temperature aging is developed by bringing the temperature of the wrought material to room temperature, the strength of the wrought material increases.

Further, for example, fan air cooling, mist cooling, shower cooling or water cooling can be employed as the additional cooling treatment.

Here, if the wrought material is stored while maintaining its temperature at room temperature, the strength of the wrought material further increases due to the room temperature aging effect. While a longer room temperature aging time increases the strength more in the initial phase, the room temperature aging effect becomes saturated in case the room temperature aging time is 24 hours or more.

Next, artificial aging treatment is carried out that heats the wrought material, which was cooled to room temperature as described above. $MgZn_2$ finely and uniformly precipitates within the wrought material by carrying out the artificial aging treatment. Therefore, the proof stress of the wrought material can be easily increased to 350 MPa or more. Any of the following aspects is applicable as specific conditions for the artificial aging treatment.

As one aspect of the specific conditions for the artificial aging treatment, the processing conditions include carrying out a first artificial aging treatment that heats the wrought material at a temperature of 80° C. to 120° C. for 1 hour to 5 hours and thereafter continuous with the first artificial aging treatment, carrying out a second artificial aging treatment that heats the wrought material at a temperature of 130° C. to 200° C. for 2 hours to 15 hours.

Here, the phrase "continuously carrying out the first artificial aging treatment and the second artificial aging treatment" means that, after completion of the first artificial aging treatment, the second artificial aging treatment is carried out while maintaining the temperature of the wrought material. Specifically, it is only needed that the wrought material is not cooled during the time from the first artificial aging treatment to the second artificial aging treatment, and, for example as a specific method, there is a method that carries out the second artificial aging treatment without taking the wrought material out of a heat treatment furnace after the first artificial aging treatment.

Thus, the artificial aging treatment time can be shortened by continuously carrying out the first artificial aging treatment and the second artificial aging treatment. Further, the treatment temperature during the second artificial aging treatment is preferably 130° C. to 200° C. When heating is carried out at a temperature falling within the range of 170° C. to 200° C. during the second artificial aging treatment, the ductility of the wrought material becomes great, so that the workability can be further improved. It is noted that, if the second artificial aging treatment is carried out according to conditions falling outside the above-described temperature range or time range, the proof stress of the resulting wrought material is likely to be less than 350 MPa.

Furthermore, as another aspect of the specific conditions for the artificial aging treatment, the processing conditions include carrying out a process that heats the wrought material at a temperature of from 100° C. to 170° C. for 5 hours to 30 hours.

In this case, because the manufacturing steps are simplified, the manufacturing can be easily performed. When the artificial aging treatment falls outside the temperature range or time range, the proof stress of the resulting wrought material is likely to be less than 350 MPa. Thus, a wrought material having sufficient strength characteristics cannot be easily obtained.

EMBODIMENTS

Example 1

An Example relating to the above-described high-strength aluminum alloy material will be described with reference to Tables 1 and 2.

In this Example, samples (No. 1 to No. 28) that varied the chemical composition of the aluminum alloy material, as indicated in Table 1, were prepared according to the same manufacturing conditions, and strength measurements and metallographic structure of each sample were performed. Further, after each sample was subjected to a surface treatment, a surface quality evaluation was performed.

Hereinafter, the manufacturing conditions, the strength measuring method and the metallographic structure observing method, as well as the surface treatment method and the surface quality evaluating method of each sample, will be described.

<Manufacturing Conditions of the Samples>

Ingots with a diameter of 90 mm comprised of the chemical compositions indicated in Table 1 are cast by semi-continuous casting. Thereafter, the ingots are subjected to a homogenization treatment that involves heating them at a temperature of 550° C. for 12 hours. Then, the ingots are subjected to the hot extrusion in a state where the temperature of the ingots is 520° C., thereby forming wrought materials having a width of 150 mm and a thickness of 10 mm. Then, while the temperature of the wrought materials is 505° C., the wrought materials are subjected to a quenching treatment that cools the wrought materials to 100° C. at an average cooling rate of 600° C./sec. The wrought materials subjected to the quenching treatment are cooled to room temperature, and subjected to room temperature aging at room temperature for 24 hours, and thereafter subjected to a first artificial aging treatment that heats the wrought materials at a temperature of 100° C. for 4 hours by use of a heat treatment furnace. Then, the in-furnace temperature is raised to 160° C. without taking the wrought materials out of the heat treatment furnace, and the wrought materials are subjected to a second artificial aging treatment that heats the wrought materials at 160° C. for 8 hours to prepare samples.

<Strength Measuring Method>

Test pieces are collected from the samples by a method in accordance with JIS Z2241 (ISO 6892-1) and measurements of the tensile strength, proof stress and elongation are performed. As a result, those exhibiting a proof stress of 350 MPa or more are judged to be acceptable.

<Metallographic Structure Observing Method>

After performing electrolytic polishing on the samples, microscopic images of the sample surfaces are obtained by using a polarizing light microscope having a magnification of 50 to 100. Image analysis is performed on the microscopic images to obtain the average particle diameter of the crystal grains constituting the metallographic structure of the samples, and the aspect ratio according to the sectioning method as defined in JIS G 0551 (ASTM E 112-96, ASTM E 1382-97), as described above. Also, the aspect ratio (which refers to the ratio of the crystal grain length in a direction parallel to the hot working direction to the crystal grain length in a direction perpendicular to the hot working direction) is calculated by dividing the average particle diameter in a direction parallel to the hot working direction by the average particle diameter in a direction perpendicular to the hot working direction, as described above. As a result, the samples having an average particle diameter of 500 μm or less and the samples having an aspect ratio ranging from 0.5 to 4.0 are judged to be preferred results.

<Surface Treatment Method>

After buffing the surfaces of the samples that were subjected to the artificial aging treatment, the samples are etched with a sodium hydroxide solution, and then subjected to de-smutting treatment. The samples subjected to the de-smutting treatment are chemically polished using a phosphoric acid—nitric acid method at a temperature of 90° C. for 1 minute. Then, the samples subjected to chemically-polishing are subjected to anodization at a current density of 150 A/m$^2$ in a 15% sulfuric acid bath to form 10 μm anodic oxide coatings. Finally, the samples subjected to the anodization are immersed in boiling water to perform a hole-sealing treatment on the anodic oxide coatings.

<Surface Quality Evaluating Method>

The surfaces of the samples subjected to the surface treatment are visually observed. In the visual observation, the samples which did not develop any streak patterns, spotting patterns, dot-like defects or the like on their surfaces are judged to be acceptable.

Then, the color tone of the sample surfaces is measured by a color-difference meter to obtain the values of the respective coordinates in the L*a*b* color system described in JIS Z8729 (ISO7724-1). As a result, the samples having an L* value (lightness): 85 to 95 and a b* value (chromaticity of blue to yellow): 0 to 0.8 are judged to be acceptable.

The evaluation results for each of the samples prepared in the manner as described above are indicated in Table 2. Further, for the samples which were not judged as being acceptable or favorable in the evaluation results, the evaluation results are underlined in Table 2.

As can be seen from Table 2, Samples Nos. 1 to 14 were judged as being acceptable in terms of all the evaluation criteria, and exhibited excellent properties in both strength and surface quality.

As a typical example of a sample having excellent surface quality, FIG. 1 shows the observation result of the metallographic structure of Sample No. 1. The samples having excellent surface quality have a metallographic structure comprised of a granular recrystallized structure, and, at the same time, do not exhibit any streak patterns even by visual confirmation, are free of spots, and have high luster.

Sample No. 15, the Zn content of which was too low, was judged as being unacceptable in terms of proof stress because the strength improving effect could not sufficiently obtained. Further, the crystal grain diameter also became coarse, and a spotty pattern was observed. Therefore, it was judged as being unacceptable.

Sample No. 16, the Zn content of which was too high, was poor in hot workability and could not be subjected to hot extrusion with manufacturing facilities actually used.

Sample No. 17, the Mg content of which was too low, was judged as being unacceptable in terms of proof stress because the strength improving effect could not sufficiently obtained. Further, the crystal grain diameter also became coarse, and a spotty pattern was observed. Therefore, it was judged as being unacceptable.

Sample No. 18, the Mg content of which was too high, was poor in hot workability and could not be subjected to hot extrusion with manufacturing facilities actually used.

Sample No. 19, the Cu content of which was too low, was judged as being unacceptable because a scale-like pattern was observed due to the precipitate-free zone.

Sample No. 20, the Cu content of which was too high, was judged as being unacceptable because its surface became yellowish in color.

Sample No. 21, the Fe content of which was too high, was judged as being unacceptable because fibrous structures were formed and, as a result, streak patterns were visually recognized on its surface.

Sample No. 22, the Si content of which was too high, was judged as being unacceptable because fibrous structures were formed, and as a result, streak patterns were visually recognized on its surface.

Sample No. 23, the Mn content of which was too high, was judged as being unacceptable because fibrous structures were formed, and as a result, streak patterns were visually recognized on its surface.

Sample No. 24, the Cr content of which was too high, was judged as being unacceptable because its surface became yellowish in color.

Sample No. 25, the Zr content of which was too low, was judged as being unacceptable because a scale-like pattern was observed due to the precipitate-free zone.

Sample No. 26 was judged as failing to pass since fibrous structures were formed because of a too high Zr content, and, as a result, streak patterns were visually recognized on its surface.

Figure 2:
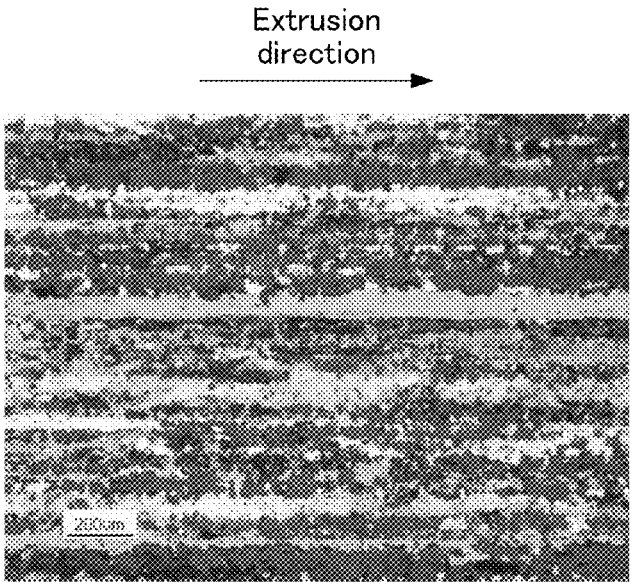
FIG. 2 shows a photograph of the fibrous structure of Sample No. 26 in Example 1.

FIG. 2 shows an observation result of the metallographic structure of Sample No. 26 as a typical example of the samples in which streak patterns were visually recognized, among the samples judged as being unacceptable in terms of surface quality. The samples in which streak patterns were visually recognized have a metallographic structure composed of fibrous structures as can be seen from FIG. 2.

Sample No. 27, the Ti content of which was too low, was judged as being unacceptable because a spotty pattern due to a coarse ingot structure appears.

Sample No. 28, the Ti content of which was too high, was judged as being unacceptable because an intermetallic compound was formed in combination with Al, and as a result, dot-like defects were visually recognized on its surface.

Example 2

Next, an Example relating to the above-described process for producing a high-strength aluminum alloy material will be described with reference to Tables 3 and 5.

In this Example, samples (Nos. A to AA) were prepared from the aluminum alloy material having the chemical composition indicated in Table 3 according to the manufacturing conditions that varied as indicated in Table 4, and strength measurements and metallographic structure observations of each sample were performed. Further, after each sample was subjected to a surface treatment, a surface quality evaluation was performed.

Hereinafter, the conditions for manufacturing the respective samples will be described in detail. Further, the strength measuring method, the metallographic structure observing method, the surface treatment method and the surface quality evaluating method for the respective samples were the same as described above in Example 1.

<Manufacturing Conditions of the Samples>

Ingots with a diameter of 90 mm comprised of the chemical composition indicated in Table 3 are cast using a semi-continuous casting technique. Thereafter, the ingots are subjected to a homogenization treatment, a hot extrusion, a quenching treatment, a first artificial aging treatment and a second artificial aging treatment in this order using the combinations of temperature and/or time and/or average cooling rate as indicated in Table 4 to obtain samples. Further, the "room temperature aging time" indicated in Table 4 corresponds to the period of time from when the wrought material reached room temperature after the quenching treatment until the first artificial aging treatment was carried out.

The evaluation results for each of the samples prepared as described above are indicated in Table 5. Further, for the samples which were not judged as being acceptable or preferable results in the respective evaluation results, the evaluation results therefor are underlined in Table 5.

As can be seen from Table 5, Samples Nos. A to R were judged as being acceptable in terms of all the evaluation criteria, and exhibited excellent properties in both strength and surface quality.

Sample S, prepared by subjecting to the homogenization treatment at a too low heating temperature, was judged as being unacceptable because the proof stress is less than 350 MPa. At the same time, the crystal grains became coarse, and a spotty pattern was also visually recognized on its surface.

Sample T, prepared by subjecting to the homogenization treatment for a too short time, was judged as being unacceptable because a proof stress is less than 350 MPa. At the same time, the crystal grains became coarse, and a spotty pattern was also visually recognized on its surface.

Sample U, prepared by heating the ingot at a too high temperature before hot extrusion working, partially melted during extrusion working, and as a result, caused hot working cracks, and thus could not be subjected to the quenching treatment and the subsequent treatments.

Sample V, prepared by subjecting to the quenching treatment at a too low average cooling rate, was judged as being unacceptable because the proof stress is less than 350 MPa due to insufficient quenching.

Sample W, prepared from a wrought material having a too high temperature after the quenching treatment, was judged as being unacceptable because the proof stress is less than 350 MPa due to insufficient quenching.

Sample X, prepared by subjecting to the second artificial aging treatment at a too low heating temperature, was judged as being unacceptable because the proof stress is less than 350 MPa due to insufficient quenching.

Sample Y, prepared by subjecting to the second artificial aging treatment at a too high heating temperature, was judged as being unacceptable because the proof stress is less than 350 MPa due to over-aging.

Sample Z, prepared by subjecting to the second artificial aging treatment for a too short time, was judged as being unacceptable because the proof stress is less than 350 MPa due to insufficient quenching.

Sample AA, prepared by subjecting to the second artificial aging treatment for a too long time, was judged as being unacceptable because the proof stress is less than 350 MPa due to over-aging.

Example 3

This Example is a case where artificial aging treatment is carried out in a single step in the process for producing a high-strength aluminum alloy material.

<Manufacturing Conditions of the Samples>

Ingots with a diameter of 90 mm comprised of the chemical composition indicated in Table 3 are cast by a semi-continuous casting technique. Thereafter, the ingots are subjected to a homogenization treatment, a hot extrusion and a quenching treatment in this order according to the conditions for Sample A in Table 4. Then, after performing room temperature aging following the quenching treatment, the wrought material is subjected to artificial aging treatment that heats the wrought material at a temperature of 140° C. for 24 hours using a heat treatment furnace to obtain Sample AB.

Sample AB prepared as described above was measured in terms of strength and observed in terms of metallic structure by the same methods in a manner similar to as in the Example 1. Further, after each sample was subjected to a surface treatment, a surface quality evaluation was performed.

The evaluation results of Sample AB prepared as described above are indicated in Table 6. As can be seen from Table 6, Sample AB was judged as being acceptable in terms of all the evaluation criteria, and exhibited excellent properties in both strength and surface quality.

TABLE 1

| Sample No. | Zn (%) | Mg (%) | Cu (%) | Fe (%) | Si (%) | Mn (%) | Cr (%) | Zr (%) | Ti (%) | Al (%) |
|---|---|---|---|---|---|---|---|---|---|---|
| 1 | 7.23 | 1.63 | 0.03 | 0.12 | 0.06 | 0.01 | 0.008 | 0.05 | 0.02 | bal |
| 2 | 8.66 | 1.71 | 0.04 | 0.16 | 0.05 | 0.01 | 0.009 | 0.04 | 0.01 | bal |
| 3 | 7.68 | 1.34 | 0.03 | 0.15 | 0.07 | 0.02 | 0.005 | 0.06 | 0.01 | bal |
| 4 | 7.75 | 2.06 | 0.05 | 0.11 | 0.05 | 0.03 | 0.006 | 0.04 | 0.02 | bal |
| 5 | 7.83 | 1.77 | 0.01 | 0.12 | 0.04 | 0.01 | 0.007 | 0.05 | 0.008 | bal |
| 6 | 7.71 | 1.69 | 0.07 | 0.13 | 0.08 | 0.01 | 0.008 | 0.06 | 0.008 | bal |
| 7 | 8.12 | 1.72 | 0.03 | 0.22 | 0.07 | 0.02 | 0.006 | 0.04 | 0.01 | bal |
| 8 | 8.03 | 1.73 | 0.03 | 0.10 | 0.20 | 0.01 | 0.005 | 0.05 | 0.02 | bal |
| 9 | 8.18 | 1.77 | 0.04 | 0.15 | 0.09 | 0.04 | 0.008 | 0.04 | 0.01 | bal |
| 10 | 7.89 | 1.69 | 0.05 | 0.11 | 0.08 | 0.02 | 0.01 | 0.04 | 0.01 | bal |
| 11 | 8.16 | 1.76 | 0.04 | 0.13 | 0.10 | 0.01 | 0.009 | 0.01 | 0.02 | bal |
| 12 | 8.25 | 1.72 | 0.04 | 0.12 | 0.08 | 0.02 | 0.005 | 0.08 | 0.01 | bal |
| 13 | 8.11 | 1.71 | 0.05 | 0.13 | 0.07 | 0.01 | 0.006 | 0.06 | 0.002 | bal |
| 14 | 8.04 | 1.68 | 0.03 | 0.15 | 0.05 | 0.01 | 0.008 | 0.05 | 0.04 | bal |
| 15 | 7.16 | 1.73 | 0.02 | 0.16 | 0.06 | 0.01 | 0.008 | 0.03 | 0.01 | bal |
| 16 | 8.79 | 1.88 | 0.03 | 0.18 | 0.05 | 0.01 | 0.009 | 0.05 | 0.01 | bal |
| 17 | 7.81 | 1.25 | 0.03 | 0.11 | 0.03 | 0.02 | 0.007 | 0.05 | 0.01 | bal |
| 18 | 7.83 | 2.17 | 0.02 | 0.10 | 0.07 | 0.02 | 0.008 | 0.06 | 0.02 | bal |
| 19 | 8.06 | 1.79 | 0.007 | 0.17 | 0.04 | 0.01 | 0.007 | 0.04 | 0.01 | bal |
| 20 | 8.01 | 1.78 | 0.12 | 0.21 | 0.09 | 0.01 | 0.007 | 0.05 | 0.02 | bal |
| 21 | 7.92 | 1.74 | 0.04 | 0.34 | 0.06 | 0.02 | 0.008 | 0.03 | 0.008 | bal |
| 22 | 7.77 | 1.78 | 0.06 | 0.15 | 0.33 | 0.01 | 0.009 | 0.04 | 0.01 | bal |
| 23 | 7.95 | 1.80 | 0.05 | 0.17 | 0.10 | 0.05 | 0.008 | 0.05 | 0.01 | bal |
| 24 | 7.82 | 1.78 | 0.04 | 0.11 | 0.03 | 0.02 | 0.02 | 0.06 | 0.02 | bal |
| 25 | 7.84 | 1.82 | 0.03 | 0.13 | 0.05 | 0.02 | 0.007 | 0.008 | 0.01 | bal |
| 26 | 7.90 | 1.81 | 0.05 | 0.11 | 0.05 | 0.01 | 0.007 | 0.13 | 0.01 | bal |
| 27 | 8.02 | 1.75 | 0.04 | 0.14 | 0.06 | 0.02 | 0.008 | 0.04 | 0.0008 | bal |
| 28 | 8.04 | 1.79 | 0.05 | 0.13 | 0.08 | 0.01 | 0.008 | 0.03 | 0.06 | bal |

TABLE 2

| | Strength Test | | | Observation of Metallographic Structure | | Evaluation of Surface Quality | | | |
|---|---|---|---|---|---|---|---|---|---|
| Sample No. | Tensile Strength (MPa) | Proof Stress (MPa) | Elongation (%) | Average Particle Diameter of Crystal Grains (μm) | Aspect Ratio | Result of Visual Observation | L* value | a* value | b* value |
| 1 | 376 | 355 | 9 | 140 | 1.5 | No pattern | 93 | −0.6 | 0.2 |
| 2 | 538 | 501 | 5 | 110 | 1.2 | No pattern | 86 | −0.7 | 0.7 |
| 3 | 383 | 358 | 8 | 320 | 2.6 | No pattern | 90 | −0.5 | 0.3 |
| 4 | 525 | 496 | 6 | 120 | 2.5 | No pattern | 87 | −0.6 | 0.7 |
| 5 | 501 | 476 | 7 | 210 | 3.4 | No pattern | 92 | −0.7 | 0.1 |
| 6 | 470 | 448 | 10 | 80 | 2.2 | No pattern | 87 | −0.5 | 0.8 |
| 7 | 482 | 444 | 7 | 120 | 1.6 | No pattern | 89 | −0.6 | 0.3 |
| 8 | 466 | 437 | 9 | 230 | 1.4 | No pattern | 89 | −0.5 | 0.3 |
| 9 | 459 | 433 | 8 | 130 | 1.3 | No pattern | 87 | −0.7 | 0.6 |
| 10 | 477 | 445 | 7 | 110 | 1.2 | No pattern | 88 | −0.6 | 0.7 |
| 11 | 461 | 431 | 7 | 220 | 3.5 | No pattern | 89 | −0.5 | 0.5 |
| 12 | 462 | 436 | 9 | 70 | 0.7 | No pattern | 90 | −0.6 | 0.6 |
| 13 | 478 | 447 | 7 | 150 | 1.7 | No pattern | 90 | −0.5 | 0.3 |
| 14 | 472 | 439 | 6 | 140 | 1.5 | No pattern | 89 | −0.5 | 0.3 |

TABLE 2-continued

| Sample No. | Strength Test: Tensile Strength (MPa) | Proof Stress (MPa) | Elongation (%) | Observation of Metallographic Structure: Average Particle Diameter of Crystal Grains (μm) | Aspect Ratio | Evaluation of Surface Quality: Result of Visual Observation | L* value | a* value | b* value |
|---|---|---|---|---|---|---|---|---|---|
| 15 | 371 | 340 | 3 | 560 | 4.5 | Spotty pattern | 93 | −0.4 | 0.5 |
| 16 | Out of production due to low extrusion rate | | | | | | | | |
| 17 | 340 | 336 | 3 | 570 | 4.4 | Spotty pattern | 92 | −0.4 | 0.6 |
| 18 | Out of production due to low extrusion rate | | | | | | | | |
| 19 | 455 | 421 | 2 | 170 | 2.7 | scale-like pattern | 90 | −0.5 | 0.2 |
| 20 | 483 | 452 | 13 | 120 | 1.3 | No pattern | 83 | −0.9 | 1.1 |
| 21 | 460 | 433 | 8 | Not measurable due to fibrous structure | | Streaky pattern | 89 | −0.4 | 0.6 |
| 22 | 481 | 447 | 7 | Not measurable due to fibrous structure | | Streaky pattern | 88 | −0.5 | 0.5 |
| 23 | 474 | 441 | 8 | Not measurable due to fibrous structure | | Streaky pattern | 88 | −0.5 | 0.6 |
| 24 | 469 | 438 | 5 | 130 | 1.5 | No pattern | 82 | −0.9 | 1.7 |
| 25 | 451 | 420 | 8 | 180 | 2.3 | scale-like pattern | 90 | −0.6 | 0.4 |
| 26 | 470 | 436 | 7 | Not measurable dueto fibrous structure | | Streaky pattern | 88 | −0.5 | 0.5 |
| 27 | 482 | 446 | 8 | Not measurable due to coarse ingot structure | | Spotty pattern | 89 | −0.4 | 0.5 |
| 28 | 483 | 450 | 6 | 110 | 1.7 | Dot-like defect | 89 | −0.5 | 0.4 |

TABLE 3

| Zn (%) | Mg (%) | Cu (%) | Fe (%) | Si (%) | Mn (%) | Cr (%) | Zr (%) | Ti (%) | Al (%) |
|---|---|---|---|---|---|---|---|---|---|
| 8.04 | 1.77 | 0.05 | 0.16 | 0.08 | 0.01 | 0.008 | 0.06 | 0.01 | bal |

TABLE 4

| Sample No. | Homogenization Treatment: Heating Temperature (° C.) | Homogenization Treatment: Heating Time (Hour) | Hot Extrusion: Ingot Temperature before Exrusion (° C.) | Quenching Treatment: Temperature before Quenching (° C.) | Quenching Treatment: Cooling Rate (° C./second) | Quenching Treatment: Temperature immediately after quenching (° C.) | Quenching Treatment: Room Temperature Aging Time (Hour) | First Artificial Aging Treatment: Treatment Temperature (° C.) | First Artificial Aging Treatment: Treatment Time (Hour) | Second Artificial Aging Treatment: Treatment Temperature (° C.) | Second Artificial Aging Treatment: Treatment Time (Hour) |
|---|---|---|---|---|---|---|---|---|---|---|---|
| A | 543 | 12 | 515 | 451 | 250 | 120 | 24 | 90 | 2 | 140 | 7 |
| B | 575 | 12 | 518 | 462 | 170 | 100 | 24 | 90 | 2 | 140 | 7 |
| C | 563 | 1 | 503 | 478 | 230 | 120 | 24 | 100 | 3 | 140 | 7 |
| D | 561 | 24 | 505 | 481 | 310 | 110 | 24 | 100 | 3 | 140 | 7 |
| E | 558 | 12 | 444 | 423 | 260 | 100 | 48 | 90 | 3 | 150 | 8 |
| F | 562 | 12 | 554 | 426 | 270 | 100 | 48 | 90 | 3 | 150 | 8 |
| G | 565 | 14 | 505 | 484 | 5 | 130 | 48 | 110 | 2 | 150 | 8 |
| H | 552 | 14 | 504 | 486 | 980 | 120 | 48 | 110 | 2 | 150 | 8 |
| I | 562 | 12 | 513 | 463 | 70 | 150 | 24 | 90 | 3 | 140 | 9 |
| J | 566 | 12 | 512 | 465 | 80 | 120 | 240 | 90 | 3 | 140 | 9 |
| K | 556 | 14 | 516 | 478 | 350 | 130 | 24 | 80 | 3 | 160 | 9 |
| L | 553 | 14 | 514 | 475 | 270 | 100 | 24 | 120 | 3 | 160 | 9 |
| M | 561 | 14 | 504 | 468 | 340 | 90 | 24 | 100 | 1 | 150 | 8 |
| N | 563 | 14 | 505 | 466 | 330 | 90 | 24 | 100 | 5 | 150 | 8 |
| O | 560 | 12 | 514 | 473 | 280 | 120 | 24 | 100 | 3 | 130 | 8 |
| P | 555 | 12 | 518 | 471 | 290 | 130 | 24 | 100 | 3 | 200 | 8 |
| Q | 568 | 12 | 514 | 461 | 310 | 100 | 24 | 90 | 3 | 150 | 2 |
| R | 561 | 12 | 513 | 467 | 330 | 110 | 24 | 90 | 3 | 150 | 15 |
| S | 534 | 12 | 514 | 473 | 160 | 110 | 24 | 90 | 2 | 140 | 8 |
| T | 568 | 0.5 | 511 | 475 | 250 | 120 | 24 | 90 | 2 | 140 | 8 |
| U | 562 | 12 | 566 | Hot working crack caused by locally melting was generated | | | | | | | |
| V | 563 | 12 | 527 | 462 | 4 | 120 | 24 | 90 | 2 | 140 | 8 |
| W | 565 | 12 | 517 | 467 | 60 | 160 | 24 | 90 | 2 | 140 | 8 |
| X | 565 | 12 | 502 | 466 | 130 | 120 | 24 | 90 | 2 | 120 | 8 |

TABLE 4-continued

| Sample No. | Homogenization Treatment: Heating Temperature (° C.) | Homogenization Treatment: Heating Time (Hour) | Hot Extrusion: Ingot Temperature before Exrusion (° C.) | Quenching Treatment: Temperature before Quenching (° C.) | Quenching Treatment: Cooling Rate (° C./second) | Quenching Treatment: Temperature immediately after quenching (° C.) | Quenching Treatment: Room Temperature Aging Time (Hour) | First Artificial Aging Treatment: Treatment Temperature (° C.) | First Artificial Aging Treatment: Treatment Time (Hour) | Second Artificial Aging Treatment: Treatment Temperature (° C.) | Second Artificial Aging Treatment: Treatment Time (Hour) |
|---|---|---|---|---|---|---|---|---|---|---|---|
| Y | 572 | 12 | 505 | 472 | 160 | 120 | 24 | 90 | 2 | 210 | 8 |
| Z | 567 | 12 | 513 | 468 | 150 | 110 | 24 | 90 | 2 | 140 | 1 |
| AA | 568 | 12 | 516 | 467 | 140 | 110 | 24 | 90 | 2 | 140 | 16 |

TABLE 5

| Sample No. | Strength Test: Tensile Strength (MPa) | Strength Test: Proof Stress (MPa) | Strength Test: Elongation (%) | Observation of Metallographic Structure: Average Particle Diameter of Crystal Grains (μm) | Observation of Metallographic Structure: Aspect Ratio | Evaluation of Surface Quality: Result of Visual Observation | Evaluation of Surface Quality: L* value | Evaluation of Surface Quality: a* value | Evaluation of Surface Quality: b* value |
|---|---|---|---|---|---|---|---|---|---|
| A | 423 | 381 | 5 | 370 | 2.6 | No pattern | 89 | −0.6 | 0.2 |
| B | 488 | 455 | 6 | 160 | 1.1 | No pattern | 88 | −0.7 | 0.3 |
| C | 402 | 378 | 6 | 350 | 2.8 | No pattern | 90 | −0.5 | 0.3 |
| D | 512 | 481 | 5 | 140 | 2.2 | No pattern | 87 | −0.6 | 0.4 |
| E | 407 | 374 | 8 | 290 | 3.5 | No pattern | 91 | −0.7 | 0.5 |
| F | 470 | 469 | 8 | 110 | 2.3 | No pattern | 89 | −0.4 | 0.4 |
| G | 391 | 360 | 8 | 370 | 3.0 | No pattern | 87 | −0.6 | 0.3 |
| H | 517 | 483 | 8 | 100 | 1.3 | No pattern | 90 | −0.8 | 0.4 |
| I | 397 | 364 | 6 | 320 | 3.1 | No pattern | 91 | −0.6 | 0.2 |
| J | 400 | 369 | 6 | 90 | 1.7 | No pattern | 90 | −0.5 | 0.2 |
| K | 403 | 371 | 8 | 140 | 2.6 | No pattern | 88 | −0.4 | 0.3 |
| L | 456 | 428 | 9 | 210 | 2.0 | No pattern | 88 | −0.5 | 0.3 |
| M | 403 | 373 | 8 | 120 | 1.8 | No pattern | 87 | −0.6 | 0.2 |
| N | 471 | 437 | 8 | 150 | 1.8 | No pattern | 87 | −0.5 | 0.2 |
| O | 389 | 357 | 2 | 160 | 1.7 | No pattern | 89 | −0.7 | 0.3 |
| P | 461 | 468 | 15 | 140 | 1.9 | No pattern | 88 | −0.4 | 0.2 |
| Q | 399 | 361 | 5 | 70 | 1.8 | No pattern | 90 | −0.5 | 0.5 |
| R | 475 | 444 | 10 | 170 | 1.9 | No pattern | 89 | −0.5 | 0.4 |
| S | 361 | 328 | 5 | 590 | 4.7 | Spotty pattern | 88 | −0.4 | 0.5 |
| T | 372 | 338 | 5 | 560 | 4.6 | Spotty pattern | 89 | −0.5 | 0.4 |
| U | Hot working crack caused by locally melting was generated | | | | | | | | |
| V | 366 | 327 | 5 | 250 | 3.2 | No pattern | 87 | −0.6 | 0.3 |
| W | 358 | 320 | 5 | 190 | 2.6 | No pattern | 88 | −0.4 | 0.4 |
| X | 369 | 326 | 1 | 160 | 1.9 | No pattern | 87 | −0.5 | 0.3 |
| Y | 373 | 331 | 15 | 180 | 1.8 | No pattern | 88 | −0.6 | 0.3 |
| Z | 362 | 327 | 2 | 170 | 1.8 | No pattern | 89 | −0.5 | 0.4 |
| AA | 358 | 324 | 6 | 180 | 1.7 | No pattern | 89 | −0.5 | 0.4 |

TABLE 6

| Sample No. | Strength Test: Tensile Strength (MPa) | Strength Test: Proof Stress (MPa) | Strength Test: Elongation (%) | Observation of Metallographic Structure: Average Particle Diameter of Crystal Grains (μm) | Observation of Metallographic Structure: Aspect Ratio | Evaluation of Surface Quality: Result of Visual Observation | Evaluation of Surface Quality: L* value | Evaluation of Surface Quality: a* value | Evaluation of Surface Quality: b* value |
|---|---|---|---|---|---|---|---|---|---|
| AB | 416 | 388 | 5 | 350 | 2.4 | No pattern | 89 | −0.5 | 0.3 |

Example 4

This Example is a case where the wrought material in the process for producing a high-strength aluminum alloy material was prepared by hot rolling. The process for producing a high-strength aluminum alloy material according to this Example is as follows.

<Manufacturing Conditions of the Samples>

A plate material with a thickness of 15 mm comprised of the chemical composition indicated in Table 7 is cast by DC casting, and its surface is faced. Then, the plate material is subjected to a homogenization treatment that heats the plate material and retains it at a temperature of 560° C. for 12 hours. Thereafter, the ingot is hot-rolled, in a state where the temperature of the plate material is 450° C., to form a wrought material having a thickness of 3 mm. Then, while the temperature of the wrought materials is 404° C., the wrought materials are subjected to a quenching treatment that cools the wrought material to 60° C. at an average cooling rate of 950° C./sec. The wrought material subjected to the quenching treatment is cooled to room temperature, and subjected to room temperature aging at room temperature for 48 hours, and thereafter subjected to first artificial aging treatment that heats the wrought material at a temperature of 90° C. for 3 hours using a heat treatment furnace. Then, the in-furnace temperature is raised to 150° C. without taking the wrought material out of the heat treatment furnace, and second artificial aging treatment that heats the wrought material at 150° C. for 8 hours is carried out to prepare a sample (No. 29).

Figure 3:
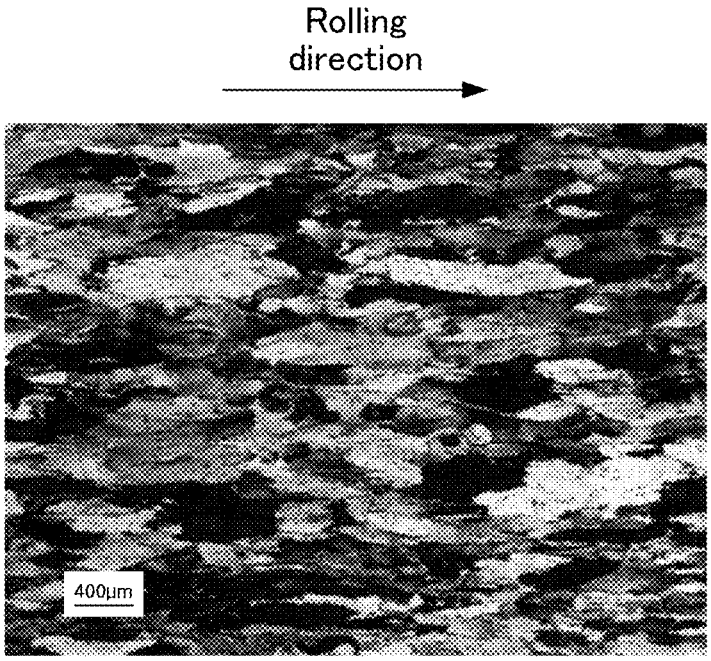
FIG. 3 shows a photograph of the recrystallized structure of Sample No. 29 in Example 4.

Table 8 and FIG. 3 show the results of the strength measurement, metallographic structure observation, surface treatment and surface quality evaluation conducted for Sample No. 29 prepared as described above in a manner similar to as in Example 1. As can be seen from Table 8 and FIG. 3, Sample No. 29 was judged as being acceptable in terms of all the evaluation criteria, and exhibited excellent properties in both strength and surface quality.

The manufacturing conditions of the samples judged as acceptable in terms of all the evaluation criteria, among the respective samples indicated in Examples 1 to 4, are equivalent to the conditions which ensure the generation of a dynamic recrystallized structure in the hot working step. When no dynamic recrystallized structure is generated in the hot working step, it is also, of course, possible to add a heat treatment step, such as an annealing treatment, separately to generate a static recrystallized structure.

TABLE 7

| Zn (%) | Mg (%) | Cu (%) | Fe (%) | Si (%) | Mn (%) | Cr (%) | Zr (%) | Ti (%) | Al (%) |
|---|---|---|---|---|---|---|---|---|---|
| 8.06 | 1.74 | 0.06 | 0.09 | 0.07 | <0.01 | <0.01 | 0.06 | 0.01 | bal |

TABLE 8

| | Strength Test | | | Observation of Metallographic Structure | | Evaluation of Surface Quality | | | |
|---|---|---|---|---|---|---|---|---|---|
| Sample No. | Tensile Strength (MPa) | Proof Stress (MPa) | Elongation (%) | Average Particle Diameter of Crystal Grains (μm) | Aspect Ratio | Result of Visual Observation | L* value | a* value | b* value |
| 29 | 413 | 377 | 13 | 245 | 3.2 | No pattern | 91 | −0.7 | 0.5 |

The invention claimed is:

1. An aluminum alloy material, comprising in mass percent:

Zn: more than 7.2% and 8.7% or less,
Mg: 1.3% or more and 2.1% or less,
Cu: 0.01% or more and 0.10% or less,
Zr: 0.01% or more and 0.10% or less,
Cr: less than 0.02%,
Fe: 0.30% or less,
Si: 0.30% or less,
Mn: less than 0.05%,
Ti: 0.001% or more and 0.05% or less,
the balance being Al and unavoidable impurities;

wherein the aluminum alloy material has a proof stress of 350 MPa or more, and a metallographic structure consisting essentially of a recrystallized structure, and the aluminum alloy material has a composition and microstructure capable of achieving an L* value, as defined in ISO 7724-1, of 85-95 and a b* value, as defined in ISO 7724-1, of 0-0.8, as measured after anodization of the aluminum alloy material in a sulfuric acid bath.

2. The aluminum alloy material according to claim 1, wherein:

the recrystallized structure includes crystal grains having an average particle diameter of 500 μm or less, and a crystal grain length in a direction parallel to a hot working direction is 0.5 to 4 times as long as a crystal grain length in a direction perpendicular to the hot working direction.

3. The aluminum alloy material according to claim 2, wherein Zn is more than 7.5% and 8.5% or less.

4. The aluminum alloy material according to claim 3, wherein the crystal grains have an average particle diameter of 50 μm or more.

5. The aluminum alloy material according to claim 4, wherein the recrystallized structure is a granular recrystallized structure.

6. The aluminum alloy material according to claim 1, wherein Zn is more than 7.5% and 8.5% or less.

7. The aluminum alloy material according to claim 2, wherein the crystal grains have an average particle diameter of 50 μm or more.

8. The aluminum alloy material according to claim 1, wherein the recrystallized structure is a granular recrystallized structure.

9. A process for producing the aluminum alloy material according to claim 1, which comprises:

preparing an ingot having a chemical composition which comprises in mass percent Zn: more than 7.2% and 8.7% or less, Mg: 1.3% or more and 2.1% or less, Cu: 0.01% or more and 0.10% or less, Zr: 0.01% or more and 0.10% or less, Cr: less than 0.02%, Fe: 0.30% or less, Si: 0.30% or less, Mn: less than 0.05%, Ti: 0.001% or more and 0.05% or less, the balance being Al and unavoidable impurities;

performing a homogenization treatment that heats the ingot at a temperature of higher than 540° C. and 580° C. or lower for 1 hour to 24 hours;

subsequently, forming a wrought material by performing hot working on the ingot in a state where the temperature of the ingot at the beginning of the working is 440° C. to 560° C.;

while the wrought material is still at 400° C. or higher, starting to cool it and subsequently performing a quenching treatment such that, while the wrought material is cooling down from 400° C. to 150° C., the average cooling rate is 5° C./sec. or more and 1000° C./sec. or less;

cooling the temperature of the wrought material to room temperature by said quenching treatment or by an additional cooling treatment; and thereafter, performing a first artificial aging treatment that heats the wrought material at a temperature of 80° C. to 120° C. for 1 hour to 5 hours, and continuously after the first artificial aging treatment, performing a second artificial aging treatment that heats the wrought material at a temperature of 130° C. to 200° C. for 2 hours to 15 hours, wherein the wrought material has a proof stress of 350 MPa or more, and a metallographic structure consisting essentially of a recrystallized structure, and the wrought material has a composition and microstructure capable of achieving an L* value, as defined in ISO 7724-1, of 85-95 and a b* value, as defined in ISO 7724-1, of 0-0.8, as measured after anodization of the aluminum alloy material in a sulfuric acid bath.

10. The process according to claim 9, wherein the average cooling rate during the quenching treatment is 100° C./sec. or more.

11. The process according to claim 10, wherein the hot working involves extrusion or rolling.

12. The process according to claim 11, wherein the second artificial aging treatment is performed at a temperature of 170° C. to 200° C.

13. The process according to claim 12, further comprising anodizing the wrought material after the artificial aging treatment.

14. The process according to claim 9, wherein:

the homogenization treatment is performed at 560° C. for 12 hours, the hot working comprises subjecting the ingot to hot-rolling and is initiated while the temperature of the ingot is at 450° C., the quenching treatment is initiated while the temperature of the wrought material is at 404° C. and the average cooling rate of the quenching treatment is 950° C./sec, the first artificial aging treatment involves heating the wrought material at 90° C. for 3 hours, and the second artificial aging treatment involves heating the wrought material at 150° C. for 8 hours.

15. The process according to claim 14, further comprising anodizing the wrought material after the artificial aging treatment.

16. The process according to claim 9, wherein the hot working involves extrusion or rolling.

17. The process according to claim 9, further comprising anodizing the wrought material after the artificial aging treatment.

18. The process according to claim 9, wherein the second artificial aging treatment is performed at a temperature of 170° C. to 200° C.

19. A process for producing the aluminum alloy material of claim 1, comprising:

homogenizing an ingot having the elemental composition recited in claim 1 at a temperature of higher than 540° C. and 580° C. or lower for at least 1 hour;

hot working the homogenized ingot, the hot working being initiated while the temperature of the homogenized ingot it 440° C. to 560° C.;

quenching hot worked material to 150° C. or lower, the quenching being initiated while the hot worked material is at a temperature of 400° C. or higher and is performed such that, while the wrought material is cooling down from 400° C. to 150° C., the average cooling rate is 5° C./sec. or more and 1000° C./sec. or less, cooling the hot worked material to room temperature; and subjecting the cooled material to a first artificial aging treatment at a temperature of 80° C. to 120° C. for 1 hour to 5 hours, and continuously thereafter, to a second artificial aging treatment at a temperature of 130° C. to 200° C. for 2 hours to 15 hours, wherein the aluminum alloy material has a proof stress of 350 MPa or more, and a metallographic structure consisting essentially of a recrystallized structure, and the aluminum alloy material has a composition and microstructure capable of achieving an L* value, as defined in ISO 7724-1, of 85-95 and a b* value, as defined in ISO 7724-1, of 0-0.8, as measured after anodization of the aluminum alloy material in a sulfuric acid bath.

20. A process for producing the aluminum alloy material according to claim 1, which comprises:

preparing an ingot having a chemical composition which comprises in mass percent Zn: more than 7.2% and 8.7% or less, Mg: 1.3% or more and 2.1% or less, Cu: 0.01% or more and 0.10% or less, Zr: 0.01% or more and 0.10% or less, Cr: less than 0.02%, Fe: 0.30% or less, Si: 0.30% or less, Mn: less than 0.05%, Ti: 0.001% or more and 0.05% or less, the balance being Al and unavoidable impurities;

performing a homogenization treatment that heats the ingot at a temperature of higher than 540° C. and 580° C. or lower for 1 hour to 24 hours;

subsequently, forming a wrought material by performing hot working on the ingot in a state where the temperature of the ingot at the beginning of the working is 440° C. to 560° C.;

while the wrought material is still at 400° C. or higher, starting to cool it and subsequently performing a quenching treatment such that, while the wrought material is cooling down from 400° C. to 150° C., the average cooling rate is 5° C./sec. or more and 1000° C./sec. or less;

cooling the temperature of the wrought material to room temperature by said quenching treatment or by an additional cooling treatment; and thereafter, performing an artificial aging treatment that heats the wrought material at a temperature of 100° C. to 170° C. for 5 hours to 30 hours, wherein the wrought material has a proof stress of 350 MPa or more, and a metallographic structure consisting essentially of a recrystallized structure, and the wrought material has a composition and microstructure capable of achieving an L* value, as defined in ISO 7724-1, of 85-95 and a b* value, as defined in ISO 7724-1, of 0-0.8, as measured after anodization of the aluminum alloy material in a sulfuric acid bath.

* * * * *